US007850838B2

(12) United States Patent
Dreier et al.

(10) Patent No.: US 7,850,838 B2
(45) Date of Patent: Dec. 14, 2010

(54) COLD WEATHER HYDROGEN GENERATION SYSTEM AND METHOD OF OPERATION

(75) Inventors: Ken Wayne Dreier, Madison, CT (US); Michael Thomas Kowalski, Seymour, CT (US); Stephen Charles Porter, Burlington, CT (US); Oscar Ken Chow, Simsbury, CT (US); Nicholas Paul Borland, Montpelier, VT (US); Stephen Arthur Goyette, New Hartford, CT (US)

(73) Assignee: Proton Energy Systems, Inc., Wallingford, CT (US)

( * ) Notice: Subject to any disclaimer, the term of this patent is extended or adjusted under 35 U.S.C. 154(b) by 1162 days.

(21) Appl. No.: 11/461,478

(22) Filed: Aug. 1, 2006

(65) Prior Publication Data

US 2008/0029389 A1 Feb. 7, 2008

(51) Int. Cl.
*C25B 9/00* (2006.01)
*C25B 15/00* (2006.01)

(52) U.S. Cl. ..... 205/637; 204/239; 204/274

(58) Field of Classification Search ..... 205/637; 204/239, 274

See application file for complete search history.

(56) References Cited

U.S. PATENT DOCUMENTS

| | | | | |
|---|---|---|---|---|
| 5,980,726 | A | 11/1999 | Moulthrop, Jr. et al. | |
| 6,887,601 | B2 * | 5/2005 | Moulthrop et al. | 429/17 |
| 6,905,791 | B2 | 6/2005 | Busenbender | |
| 2003/0141200 | A1 | 7/2003 | Harada | |
| 2004/0157094 | A1 | 8/2004 | Reiser et al. | |
| 2004/0191581 | A1 | 9/2004 | Reiser et al. | |
| 2005/0019628 | A1 | 1/2005 | Clark et al. | |

FOREIGN PATENT DOCUMENTS

JP 2005008933 A * 1/2005

* cited by examiner

*Primary Examiner*—Alexa D. Neckel
*Assistant Examiner*—Nicholas A. Smith
(74) *Attorney, Agent, or Firm*—Cantor Colburn LLP

(57) ABSTRACT

A system for providing hydrogen gas is provided. The system includes a hydrogen generator that produces gas from water. One or more heat generation devices are arranged to provide heating of the enclosure during different modes of operation to prevent freezing of components. A plurality of temperature sensors are arranged and coupled to a controller to selectively activate a heat source if the temperature of the component is less than a predetermined temperature.

12 Claims, 5 Drawing Sheets

COLD WEATHER HYDROGEN GENERATION SYSTEM AND METHOD OF OPERATION

FEDERAL RESEARCH STATEMENT

This invention was made with Government support under contract DE-DC36-04GO14237 awarded by the Department of Energy. The Government has certain rights in this invention.

FIELD OF INVENTION

This disclosure relates generally to a system for generating hydrogen gas from water, and especially relates to an electrochemical system for generating hydrogen gas in cold weather environments.

BACKGROUND OF THE INVENTION

Hydrogen gas is utilized in a number of industrial and energy applications. The application operator typically obtains the necessary hydrogen gas through either gas delivered in cylinders or by generating the gas from a precursor material such as water. Hydrogen gas is obtained from water through a process known as electrolysis, where hydrogen protons are disassociated from the water by an electrical current in the presence of a catalyst. Typical energy applications that utilize hydrogen gas include vehicle fueling and power systems.

The use of hydrogen as a fuel to power vehicles such as automobiles is generally considered to have the greatest potential for reducing or eliminating dependence on petroleum based fuels like gasoline. While a number of technologies, such as steam methane reformation or natural gas reformation, exist to provide the needed hydrogen, water electrolysis is generally preferred since it doesn't result in any pollutants. However, since water electrolysis equipment is prone to freezing, this type of hydrogen generator has generally been limited to warmer climates such as California and Florida.

While existing hydrogen generator systems are suitable for their intended purposes, there still remains a need for improvements for applications where the hydrogen generator systems operate in a cold environment. In particular, a need exists for a power system with appropriate safeguards that will enable it to operate autonomously and reliably for extended periods of time in cold weather while minimizing the power requirements needed to prevent freezing.

SUMMARY OF THE INVENTION

A hydrogen gas generation system is provided that includes an enclosure and at least one hydrogen generator mounted in the enclosure. The hydrogen generator has a plurality of electrochemical cells coupled in a serial electrical arrangement with each cell having an anode and a cathode. A ventilation duct having an inlet and an outlet is coupled to the enclosure where the inlet draws in fresh air into the enclosure through the outlet. At least one temperature sensor mounted within the enclosure along with a first heat generation device that is operably coupled to the at least one temperature sensor.

A method for preventing the freezing of a hydrogen gas generation system is also provided. First air flow is provided to an enclosure when hydrogen gas is being generated. The air flow is heated with a first heat source prior to or upon entering the cabinet to a temperature above the freezing point of water. The air flow is halted when hydrogen gas is not being generated to prevent the entry of cold air into the enclosure. The temperature of one or more components is monitored and a second heat source is operated if the temperature of a component falls below a predetermined threshold.

A hydrogen gas generation system is also provided that includes an enclosure with an electrochemical cell stack mounted therein. The cell stack includes a means for generating hydrogen gas coupled to an inlet for receiving water and an outlet for providing hydrogen gas. A ventilation duct having an inlet and an outlet is coupled to the enclosure where the inlet draws in fresh air or nonclassified air and the outlet exposed to the interior of the enclosure. A first heat generation device mounted to the ventilation duct between the inlet and the outlet to heat the fresh air prior to or upon entering the interior of the enclosure. A temperature sensor mounted to the cell stack or other temperature sensitive components. A second heat generation device is mounted in the enclosure and is operably coupled to the temperature sensor. Finally, a controller is operably coupled to the temperature sensors and the heat generation devices.

The above discussed and other features will be appreciated and understood by those skilled in the art from the following detailed description and drawings.

BRIEF DESCRIPTION OF THE DRAWINGS

Referring now to the drawings, which are meant to be exemplary and not limiting, and wherein like elements are numbered alike.

DESCRIPTION OF PREFERRED EMBODIMENT

Embodiments of the invention provide a method and apparatus for providing thermal management in a hydrogen generator system through selective heating of water containing components within the system depending on the current state of operation, wherein the electrochemical electrolysis cell stack is maintained at a temperature above freezing thereby providing a reliable and autonomously controlled hydrogen generator system for use in cold climates.

Figure 1:
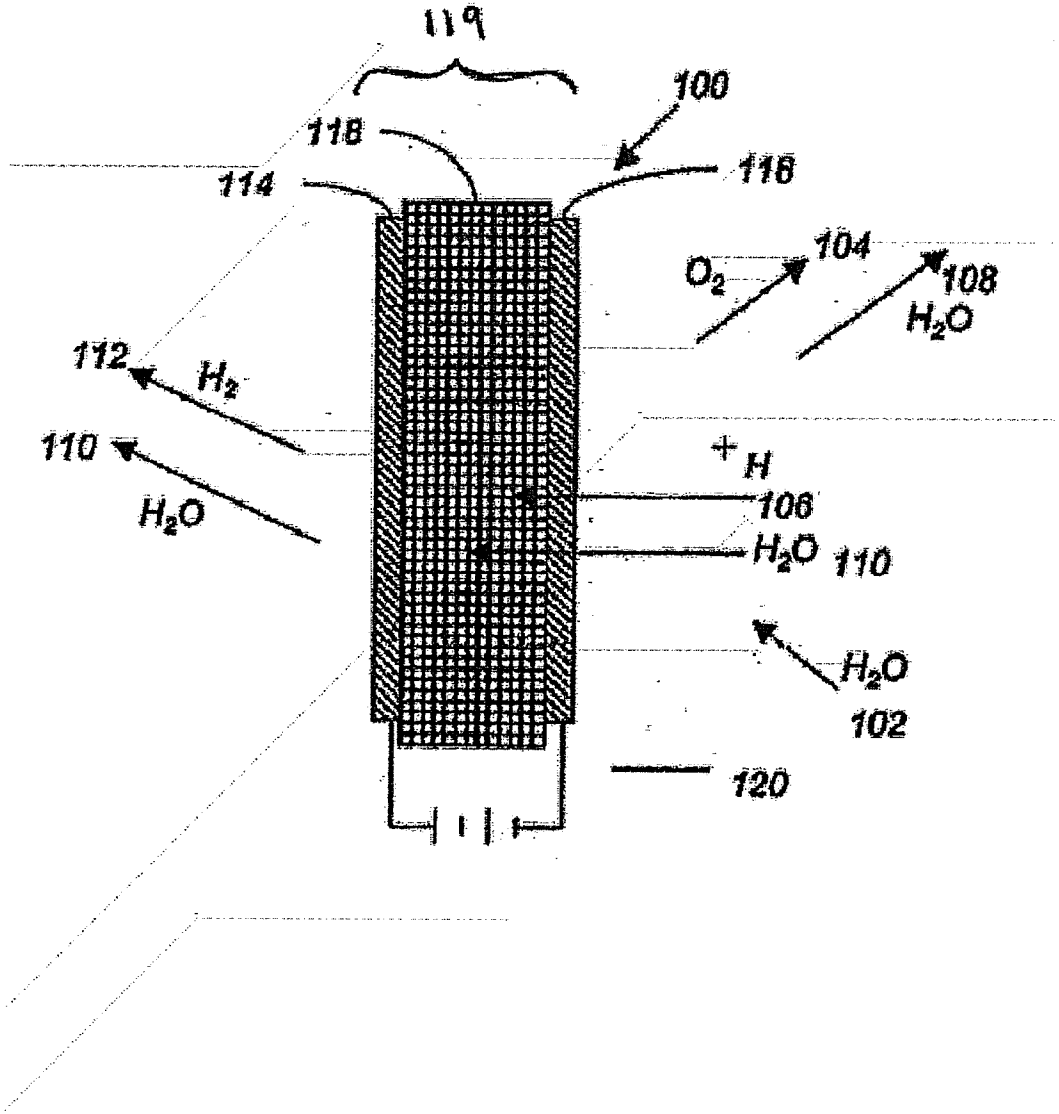
FIG. 1 is a schematic diagram of a partial prior art electrochemical cell showing an electrochemical reaction.
Figure 2:
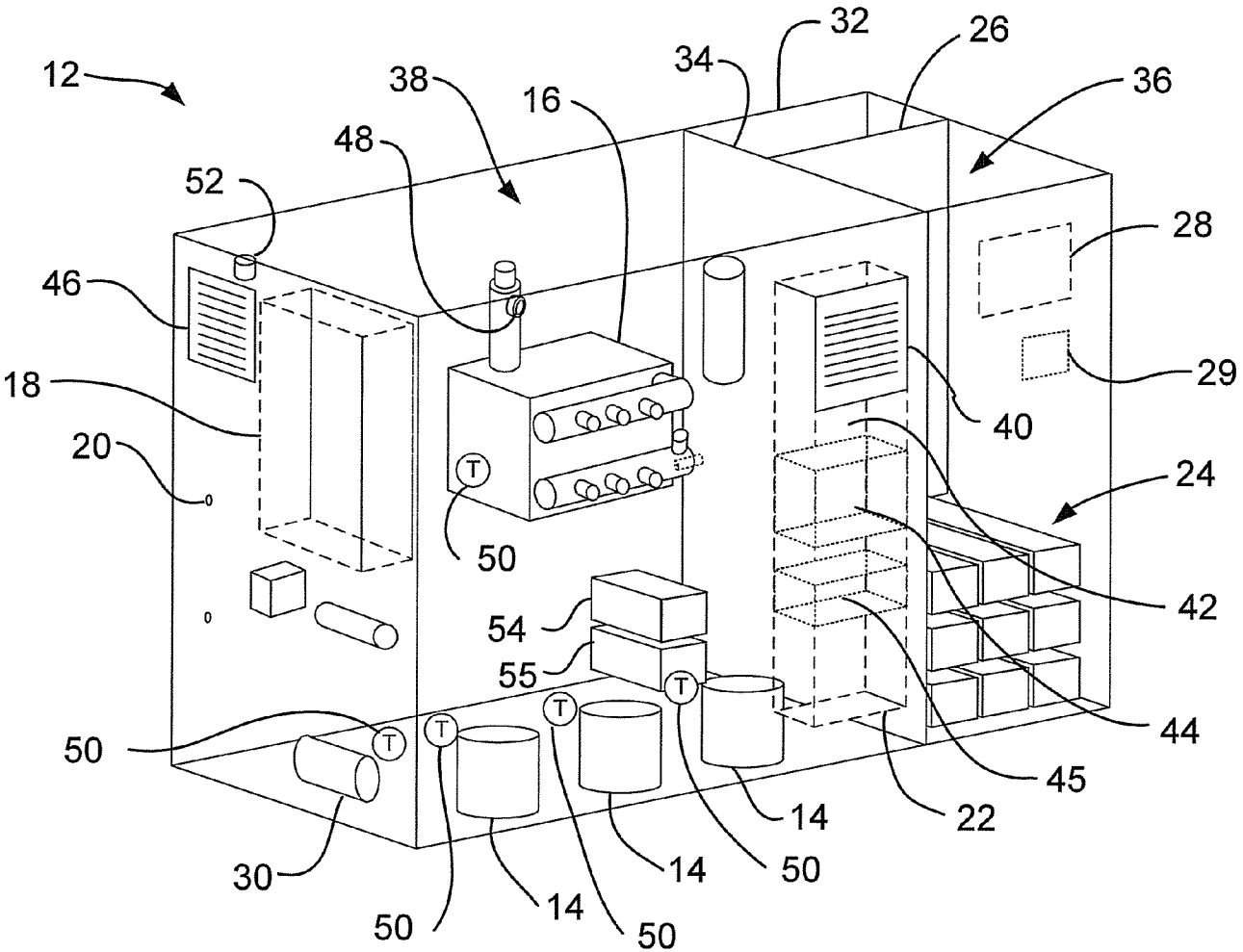
FIG. 2 is an illustration in a perspective view of an exemplary embodiment of a hydrogen generation system.

Referring to FIG. 1 and FIG. 2, an embodiment of the electrochemical system 12 is shown. Electrochemical cells 14 typically include one or more individual cells arranged in a stack, with the working fluids directed through the cells within the stack structure. The cells within the stack are sequentially arranged, each including a cathode, proton exchange membrane, and an anode (hereinafter "membrane electrode assembly", or "MEA" 119) as shown in FIG. 1. Each cell typically further comprises a first flow field in fluid communication with the cathode and a second flow field in fluid communication with the anode. The MEA 119 may be supported on either or both sides by screen packs or bipolar plates disposed within the flow fields, and which may be configured to facilitate membrane hydration and/or fluid movement to and from the MEA 119.

Membrane 118 comprises electrolytes that are preferably solids or gels under the operating conditions of the electrochemical cell. Useful materials include, for example, proton conducting ionomers and ion exchange resins. Useful proton conducting ionomers include complexes comprising an alkali metal salt, alkali earth metal salt, a protonic acid, a protonic acid salt or mixtures comprising one or more of the foregoing complexes. Counter-ions useful in the above salts include halogen ion, perchloric ion, thiocyanate ion, trifluoromethane sulfonic opn, borofuoric ion, and the like. Representative examples of such salts include, but are not limited to, lithium fluoride, sodium iodide, lithium iodide, lithium perchlorate, sodium thiocyanate, lithium trifluoromethane sulfonate, lithium borofluoride, lithium hexafluorophosphate, phosphoric acid, sulfuric acid, trifluoromethane sulfonic acid, and the like. The alkali metal salt, alkali earth metal salt, protonic acid, or protonic acid salt can be complexed with one or more polar polymers such as a polyether, polyester, or polyimide, or with a network or cross-linked polymer containing the above polar polymer as a segment. Useful polyethers include polyoxyalkylenes, such as polyethylene glycol, polyethylene glycol monoether, and polyethylene glycol diether; copolymers of at least one of these polyethers, such as poly(oxyethylene-co-oxypropylene) glycol, poly(oxyethylene-co-oxypropylene) glycol monoether, and poly(oxyethylene-co-oxypropylene) glycol diether; condensation products of ethylenediamine with the above polyoxyalkylenesl; and esters, such as phosphoric acid esters, aliphatic carboxylic acid esters or aromatic carboxylic acid esters of the above polyoxyalkylenes. Copolymers of, e.g., polyethylene glycol monoethyl ether with methacrylic acid exhibit sufficient ionic conductivity to be useful.

Ion-exchange resins useful as proton conducting materials include hydrocarbon and fluorocarbon-type resins. Hydrocarbon-type ion-exchange resins include phenolic resins, condensation resins such as phenol-formaldehyde, polystyrene, styrene-divinyl benzene copolymers, styrene-butadiene copolymers, styrene, styrene-divinylbenzene-vinylchloride terpolymers, and the like, that can be imbued with cation-exchange ability by sulfonation, or can be imbued with anion-exchange ability by chloromethylation followed by conversion to the corresponding quaternary-amine.

Fluorocarbon-type ion-exchange resins can include, for example, hydrates of tetrafluoroethylene-perfluorosulfonyl ethoxyvinyl ether or tetrafluoroethylene-hydroxylated (perfluorovinylether) copolymers and the like. When oxidation and or acid resist is desirable, for instance, at the cathode of a fuel cell, fluorocarbon-type resins having sulfonic, carboxylic and/or phosophoric acid functionality are preferred. Fluorocarbon-type resins typically exhibit excellent resistance to oxidation by halogen, strong acids, and bases. One family of fluorocarbon-type resins having sulfonic acid group functionality is NAFION™ resins (commercially available from E.I. du Pont de Nemours and Company, Wilmington, Del.).

Electrodes 114 and 116 comprise catalyst suitable for performing the needed electrochemical reaction (i.e. electrolyzing water to produce hydrogen and oxygen). Suitable electrodes comprise, but are not limited to, platinum, palladium, titanium, rhodium, carbon, gold, tantalum, tungsten, ruthenium, iridium, osmium, and the like, as well as alloys and combinations comprising one or more of the foregoing materials. Electrodes 114 and 116 can be formed on membrane 118, or may be layered adjacent to, but in contact with or in ionic communication with, membrane 118.

Flow field members (not shown) and support membrane 118, allow the passage of system fluids, and preferably are electrically conductive, and may be, for example, screen packs or bipolar plates. The screen packs include one or more layers of perforated sheets or a woven mesh formed from metal or strands. These screens typically comprise metals, for example, niobium, zirconium, tantalum, titanium, carbon steel, stainless steel, nickel, cobalt and the like, as well as alloys and combinations comprising one or more of the foregoing metals. Bipolar plates are commonly porous structures comprising fibrous carbon, or fibrous carbon impregnated with polytetrafluoroethylene or PTFE (commercially available under the trade name TEFLON® from E.I. du Pont de Nemours and Company).

Figure 3:
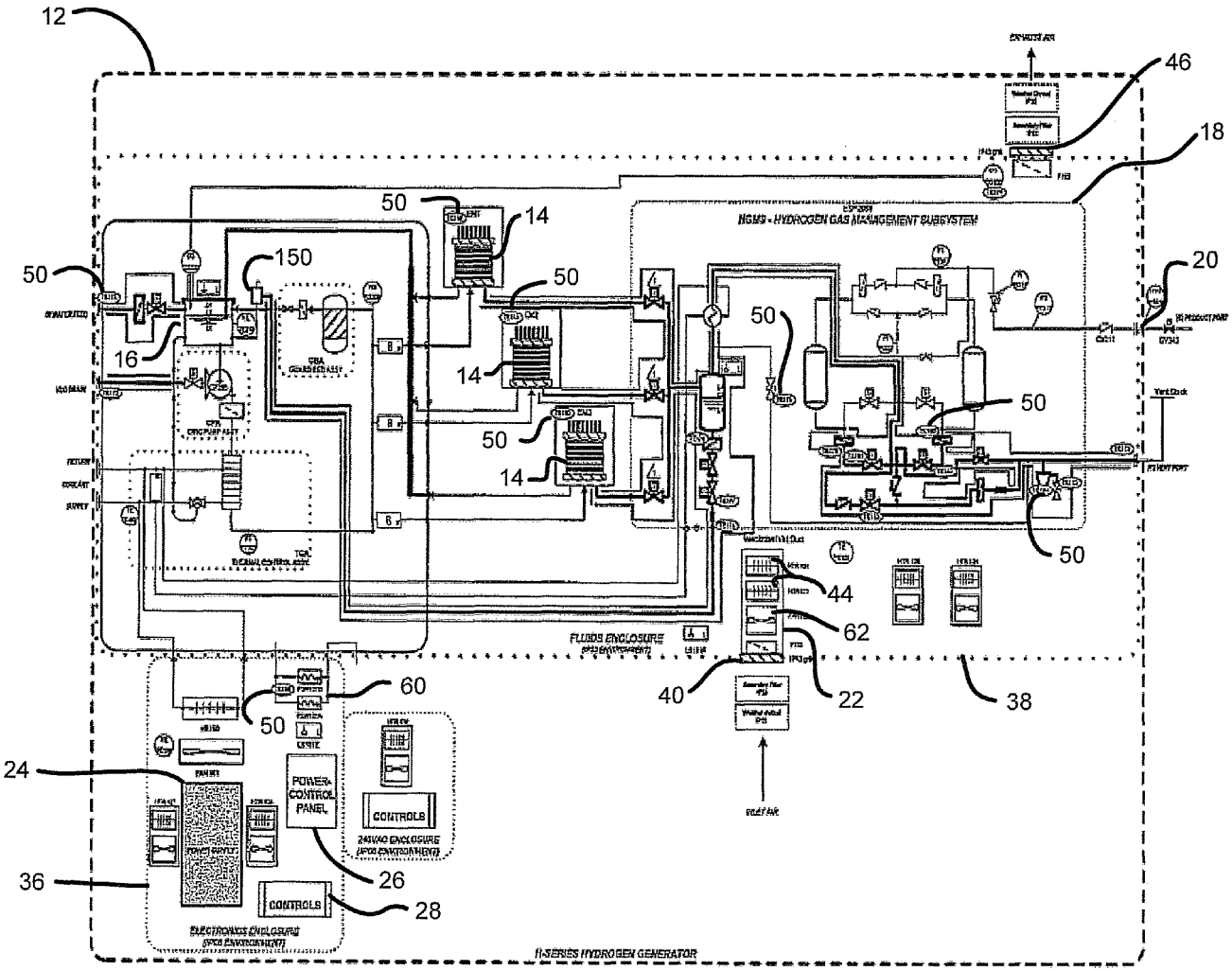
FIG. 3 is an illustration of a piping and instrumentation diagram of the hydrogen generation system of FIG. 2.

Referring now to FIG. 2 and FIG. 3, after the water is decomposed in the electrochemical cells 14 into hydrogen and oxygen gas, the respective gases leave the electrochemical cells 14 for further downstream processing. The oxygen, mixed with process water which was not decomposed by the electrochemical cell 14, is directed into a water oxygen management system 16 (herein after referred to as "WOMS"). The WOMS 16 maintains all of the water fluid functions within the electrochemical system 12, including separating the oxygen gas from the water, manifolding of water lines, monitoring of water quality, and deionizing of the water.

The hydrogen gas exits the electrochemical cells 14 along with a small amount of water which is carried over with the hydrogen protons during the process of electrolyzing the water. This hydrogen-water mixture is directed into a hydrogen gas management system 18 (hereinafter referred to as "HGMS") for further processing. The HGMS 18 separates the water from the hydrogen gas and processes the gas using an optional drying apparatus to further minimize water contamination. Finally, the hydrogen gas exits the system 12 through a port 20 for use in the end application.

The electrochemical system 12 includes further subsystems, such as a ventilation system 22, power supply modules 24, control panels 26, a user input panel 28 and other water handling and control equipment such as pump 30. It should be noted that the cabinet 32 of electrochemical system 12 is divided by a partition 34 which separates the electrical compartment 36 from the gas generation compartment 38 to prevent any inadvertent exposure of hydrogen gas to ignition sources.

The ventilation system 22 provides fresh air to the interior of the gas generation compartment 38. A fan 62 adjacent to a louvered grill 40 draws in external air. The air travels down the duct 42 and enters the interior portion of the gas generation compartment 38 adjacent the electrochemical cells 14. As will be described in more detail below, during cold weather operation, a primary purge heater 44 and a secondary purge heater 45 are located in or adjacent to the duct 42 and are activated to warm the air prior to entering the compartment. In the preferred embodiment, the air flow through the duct 42 will be between 350 scfh and 700 scfh, and more preferably less than 645 scfh. Due to the volume of air needed to adequately dilute the compartment, the primary purge heater 44 will preferably be a resistance element type of heater capable of producing between 5 kW to 20 kW, and preferably 10 kW of heat. The secondary purge heater may also be a resistance type heater producing between 3 kW to 10 kW, and preferably 4 kW of heat.

To exit the compartment 38, the air must traverse the length of the compartment 38 and exit through louvered grill 46. Due to the flow of air, the oxygen exhausted by the oxygen-water phase separator vent 48 is quickly removed from the system 12. Any hydrogen which escapes, such as hydrogen vented from the phase separator 150, is exhausted into the flow of air, diluted and quickly removed from system 12. Sensor 60 detects a loss of air ventilation and automatically causes the system 12 to stop production of oxygen and hydrogen. Additionally, an optional combustible gas sensor 52 is positioned adjacent to the exit grill 46. In the event that combustible gas levels in the vent air stream reach unacceptable levels, the system 12 is automatically shut down for maintenance or repair.

A primary standby heater 54 is located in the gas generation compartment 38. In the preferred embodiment, the primary standby heater 54 is a resistance element type heater capable of generating between 500 W to 1600 W. An additional secondary standby heater 55 may also be located in the gas generation compartment 38. Heater 55 may be identical to the primary standby 54 or be sized differently depending on the needs of the application. The standby heaters 54, 55 are operationally coupled to a controller 29. It should be appreciated that while the exemplary embodiment is being described in with reference to two standby heaters 54, 55 it is contemplated that an array of heaters may be appropriately arranged within the system 12 to provide additional heat to the compartment 38. As will be described in more detail below, the use of such an array of heaters allows for more efficient operation and cost savings to the end user.

In the embodiment described herein, the purge heaters 44, 45 and standby heaters 54, 55 are described in reference to resistance heaters. However, it is contemplated that other heaters may be utilized equally with the system 12 and method 200. For example, hydrogen catalytic heaters or burners may be incorporated that react hydrogen gas over a catalytic bed to produce heat or by burning the hydrogen gas, thus allowing a portion of the generated hydrogen to be utilized to maintain adequate temperatures within the cabinet 36. The use of excess hydrogen gas for heating further improves the efficiency of the system 12 and reduces the amount of electrical power required for operation. Other types of heaters include, but are not limited to, infrared heaters, heat pumps, hydrocarbon fired heaters, solar hot-water, geothermal heating, and thermal diodes.

A plurality of temperature sensors 50 are arranged within the system 12 to monitor the temperature of components when the system 12 is not generating hydrogen. Any number of sensors 50 may be used within the system, but will preferably be arranged on those components that are sensitive to lower temperatures or those components that are exposed to water. The sensor 50 is preferably a thermocouple or a thermistor type sensor such as Model T-Type manufactured by OMEGA Corporation. The temperature sensors are coupled to controller 29.

Controller 29 is a suitable electronic device capable of accepting data and instructions, executing the instructions to process the data, and presenting the results. Controller 29 may accept instructions through a communications cable or through other means such as but not limited to a user interface, electronic data card, voice activation means, manually-operable selection and control means, radiated wavelength and electronic or electrical transfer. Therefore, controller 29 can be a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a superconducting computer, a supercomputer, a solid-state computer, a single-board computer, a buffered computer, a computer network, a desktop computer, a laptop computer, a scientific computer, a scientific calculator, or a hybrid of any of the foregoing. Controller 29 and its functionality may be embodied in or be combined with a plurality of analog electrical and electromechanical devices, such as but not limited to diodes, resistors, capacitors, thermostats, and relays. Additionally, while controller 29 is illustrated as a separate object from control panel 26, this functionality may be embodied in a single controller for the system or in a plurality of individual distributed controllers that provide specialized functionality and provide operational controls for the system 12.

As will be described in more detail with respect to method 200, the system 12 has two main modes of operation, hydrogen generation mode and stand-by mode. When the system 12 is installed in a cold weather environment where ambient environmental temperatures may fall below the freezing point of water, the cold temperatures may place undesired stress on the components within the system. The effect of a cold ambient temperature is particularly of a concern when the system 12 is in stand-by mode since during operation, many of the internal components will generate heat.

Figure 4:
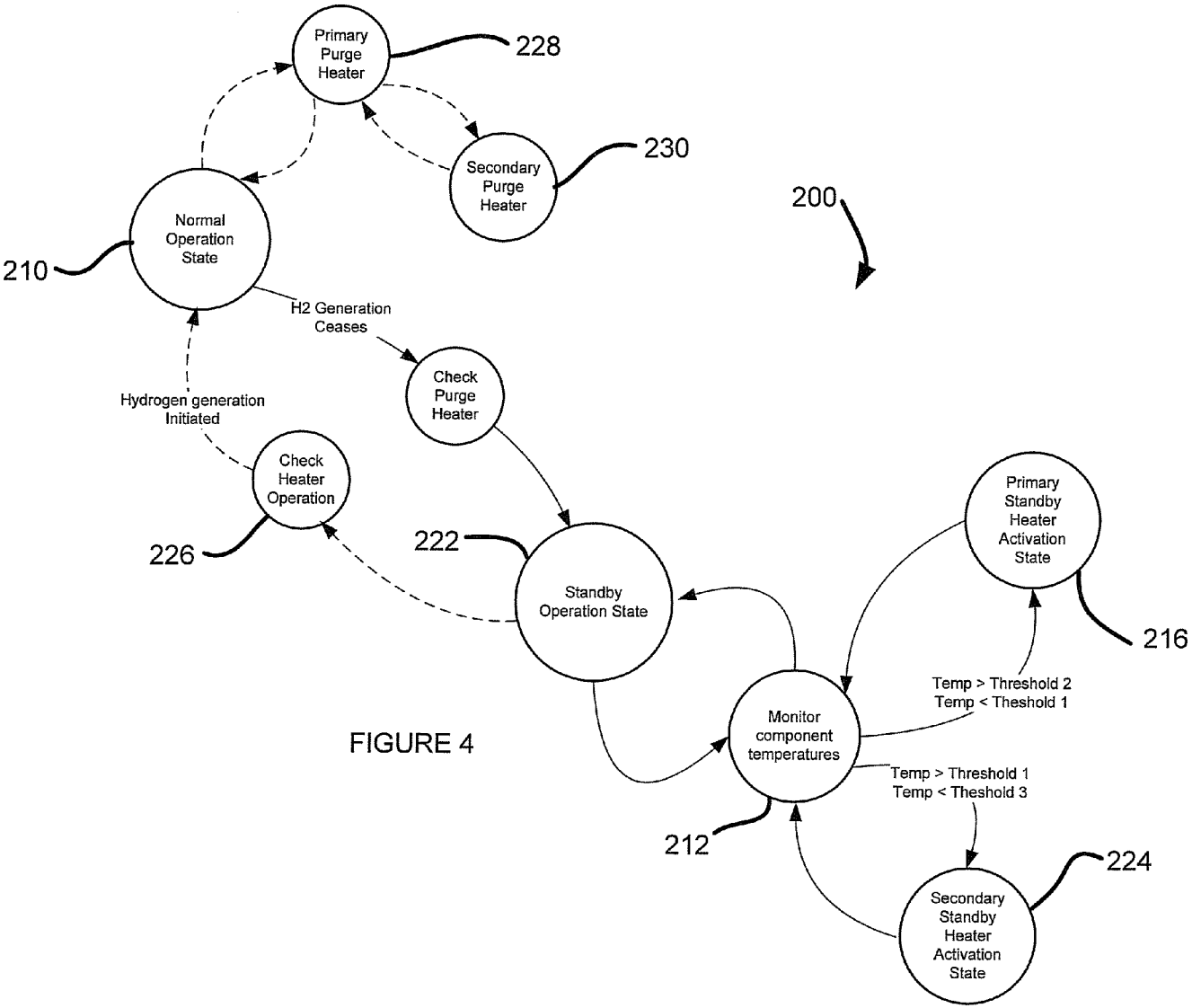
FIG. 4 is a state transition diagram illustrating an exemplary embodiment for control methodology to prevent freezing during different modes of operation due to cold ambient conditions; and, FIG. 5 is a state transition diagram illustrating an embodiment for control methodology to accommodate seasonal changes that affect the cost of operation.

A method 200 for operating the electrochemical system 12 is shown in FIG. 4. The method 200 includes numerous modes and the criterion, requirements, events and the like to control changes of state among the various modes. To perform the prescribed functions and desired processing of method 200, as well as the computations therefore (e.g. the control algorithms for hydrogen generation, and the like), controller 29, control panel 26 and the power supplies 24 may include, but not be limited to, a processor(s), computer(s), memory, storage, register(s), timing, interrupt(s), communication interface(s), and input/output signal interfaces, and the like, as well as combinations comprising at least one of the foregoing. For example, controller 29 may include input signal processing and filtering to enable accurate sampling and conversion or acquisitions of such signals from communications interfaces.

Upon startup, the system 12 initially starts at mode 210 and first checks to see the operational state of the system 12. If there is a need for hydrogen gas, the power control panel 26 allows water to flow and supplies electricity from power supplies 24 to the electrochemical cells 14. The electrochemical cells decompose the water into hydrogen and oxygen gas as described herein above. The hydrogen gas is processed in the HGMS 18 and exits the system 12 through port 20. Similarly, the oxygen gas is separated from the water in WOMS 16, enters the purge flow air stream and is removed from the system 12 via vent 46.

Periodically, the method 200 will transfer to mode 228 to monitor the temperature of the purge air entering the cabinet 36. If temperature within the cabinet 36 is below a first predetermined purge threshold, preferably below 12° C., mode 228 will activate a primary purge heater 44 to heat the air prior to entry into cabinet 36 and prevent damage to temperature sensitive components. Mode 228 will continue to operate the primary purge heater 44 until the temperature within the cabinet reaches a second purge threshold, preferably above 16° C. If the temperature within the cabinet 36 continues to drop, for example due extremely cold ambient environmental temperatures, the mode 228 will transfer to mode 230 once a third purge threshold, preferably below 8° C., and activate a secondary purge heater 45. Method 200 will continue to operate both the primary and secondary purge heaters while the cabinet temperature continues to be below a fourth purge threshold, preferably below 13° C. Once the cabinet 36 temperature rises above the fourth purge threshold, the mode 230 disables secondary purge heater 45. The primary purge heater 44 continues to operate until the second purge threshold is reached.

The method 200 continues to produce hydrogen and monitor the cabinet 36 temperature in this mode of operation while the demand for hydrogen continues. Once hydrogen production is no longer required, either through an operator command, an error indicating a malfunction, or through the detection of a drop in demand, hydrogen production will cease and the method 200 transfers to standby mode 222.

If there is no hydrogen being generated, or if the generation of hydrogen ceases as described above, the method 200 transfers to standby mode 222. The system 12 will remain in standby mode 222 until a signal is received to generate additional hydrogen gas. While in standby mode 222, process 200 will periodically monitor the temperature of selected components in the system 12. Since the system 12 utilizes water as a precursor material for electrolysis, components in the system 12 may be sensitive to changes in the environmental temperature, especially when the environmental temperature falls below the freezing point of water, 0° C. Components that may be monitored include, but are not limited to the electrochemical cell stacks 14, the WOMS 16 and the water pump 30. It is generally considered advantageous to monitor the individual components rather than the general air temperature within the cabinet 36 since arrangement allows the cabinet air temperature to vary while protecting the portions of system 12 that are most sensitive to temperature. Thus this minimizes the need for operation of standby heaters and allows for a more efficient and less costly operation of the system 12. In the exemplary embodiment, the temperature does not need to be monitored since the heat generated during operation is sufficient to prevent the component temperature from reaching the freezing point. However it is contemplated that in extreme cold weather operating environments, the heat generated during operation will be insufficient to preventing freezing and that mode 212 will operate periodically during mode 210 to monitor and maintain acceptable temperatures within the system 12.

If mode 212 determines that the temperature of one or more components has fallen below a predetermined threshold, then the method 200 shifts to a secondary heater mode 216 that activates a primary standby heater 54. In the exemplary embodiment, the primary standby heater 54 is activated between 7° C. and 10° C., and more preferably at 8° C. This first threshold temperature may be any temperature sufficiently above the freezing point of water to prevent the components from being damaged before the secondary heater has sufficient time to provide the necessary heat. Once the heater is activated, the method 200 returns to mode 212 and continues to monitor the temperature of the selected components. Once the temperature rises above a second threshold, preferably between 12° C. and 15° C., the primary standby heater 54 is deactivated.

If the temperature of the selected components continues to fall to below a third threshold, mode 212 shifts to mode 224 to activate a secondary standby heater 55 to operate in parallel to the primary standby heater 54. In the exemplary embodiment, the third threshold is between 2° C. and 5° C., and more preferably 3° C. It is contemplated that the system 12 may include one or more additional standby heaters that are sized and activated depending on the needs of the application. By providing for an array of heaters, that are activated in series to provide additional heat as necessary for the needs of the end user application. This also provides additional advantages in minimizing the amount of energy being utilized by the system 12 during periods of standby mode 212 making the system less costly to operate for the end user. When a signal is received by the method 200 to initiate or reinitiate generation of hydrogen, standby mode 222 transfers to mode 226 which determines the operation state of the standby heaters 54, 55. If the standby heaters 54, 55 are operational (e.g. generating heat), the heaters are deactivated before the method 200 loops back to operational mode 210.

Figure 5:
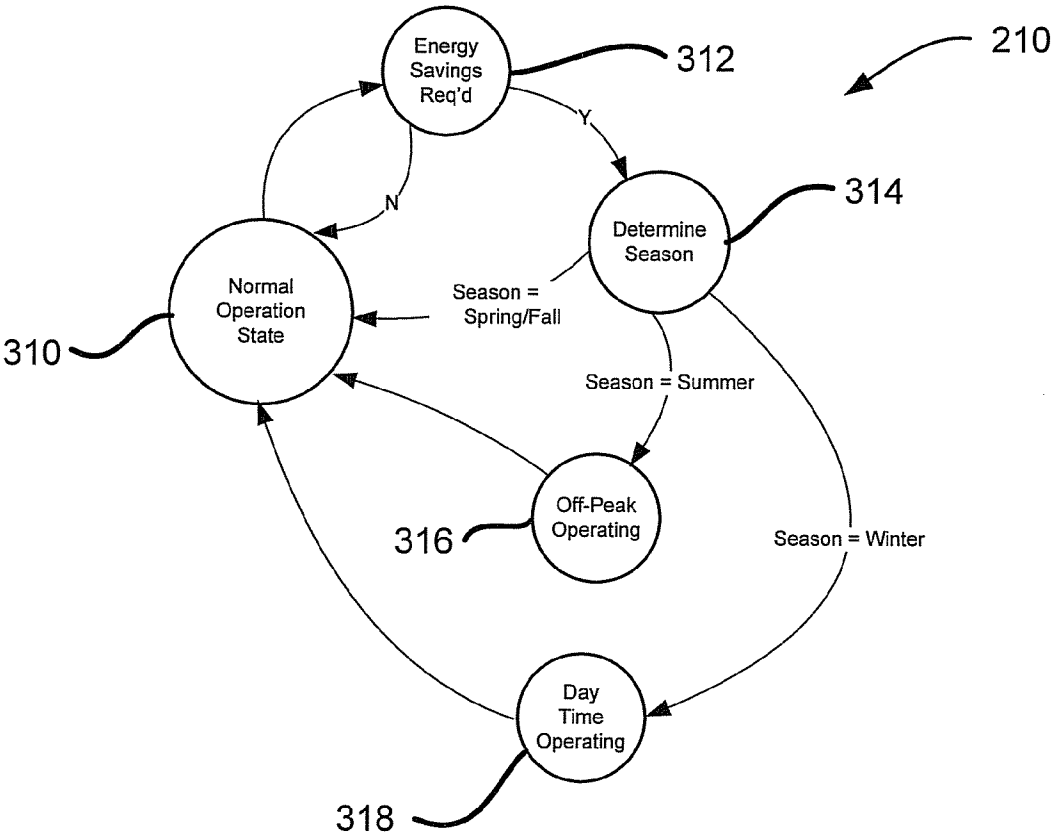

If the operator of system 12 desires to maximize cost savings, an alternate embodiment normal operating mode 210 as shown in FIG. 5 may be utilized. In this embodiment, the process 210 alters the operation of the system 12 to accommodate seasonal changes that affect the cost of operation. The normal operation mode 310 will periodically transfer to mode 312 where the process 210 determines if the operator desires to maximize cost savings. If the answer is negative, the process 210 transfers back to normal mode 310 to continue operations. If the answer is in the affirmative, then process 312 transfers to mode 314.

Mode 314 compares a date value indicative of the current date against a predetermined set of values to determine the season for the location of the system 12. By utilizing a modifiable time parameters using a technique such as a look up table, the operator can modify the operation to account for local conditions. For example, winter will begin earlier and end later in Maine when compared with New Jersey. Since the system 12 operates in bifurcated state, namely either in an open manner (operating—drawing in fresh air) or closed manner (standby—closed system) additional cost savings are possible by limiting the operation of system 12 during certain seasons (e.g. winter, spring, summer, fall) of the year. In general, it is less costly to run the standby heaters 54, 55 than the purge heaters 44, 45 since the standby heaters 54, 55 are only maintaining the air within the cabinet 36 air rather than raising the temperature external ambient purge air. Also, depending on the location of the system 12, the utility providing electrical power may charge different rates with higher rates during peak demand (during the day) and less during periods of lower demand (night time). The effect of changing operation based on seasons is at its greatest during the seasons with the largest temperature extremes, summer and winter. Therefore, in this exemplary embodiment, if mode 314 determines that it is spring or autumn, the process 210 transfers back to normal operation mode 310.

If mode 314 determines that the current season is "winter", the process 210 transfers to winter mode 318. Typically during the winter, there is an advantage to operating only during the daytime hours. Since the system 12 operates in an open manner, drawing in fresh air when hydrogen is being generated, operation of the purge heaters 44, 45 is needed to prevent freezing of components when the ambient temperature is below or approaches 0° C. To minimize the activation of the purge heaters 44, 45, mode 318 limits the operation of system 12 to times of the day when the ambient temperature is at its warmest, typically during daylight hours. This has the effect of reducing the amount of energy that is needed to heat the purge air and thus reduces the costs of operation. After adjusting the hours of operation, process 210 transfers back to mode 310.

If mode 314 determines that the current season is "summer", the process 210 transfers to summer mode 318. As discussed above, electrical utilities that provide the energy to system 12 may charge different rates depending on the time of day. Typically during the summer, peak-rates are charged during the daylight hours since this is the period of greatest demand due to the use of environmental equipment such as air conditioners. Therefore, it is advantageous to operate the system 12 during the evening and night time hours to minimize the cost of electricity consumed. Therefore, mode 316, adjusts the allowable operating times to correspond to the off-peak rates of the local utility. The off-peak time periods may change depending on location and it is contemplated that the operator can adjust the operation to match these local parameters. After adjusting the hours of operation, the process 210 transfers back to mode 310. It should be appreciated that the alternative embodiment described herein references "summer" and "winter", however there is no limit to the number of annual time periods that may be utilized to alter operation of system 12 to account for local conditions. For example, the local utility may have a period when certain electrical production resources are offline for annual routine maintenance. This may cause an increase in rates due to the importing of electrical power from other producers. The process 210 may accommodate this non-seasonal event and allow the operator to minimize the energy costs.

While the invention has been described with reference to a preferred embodiment, it will be understood by those skilled in the art that various changes may be made and equivalent structures or devices may be substituted for elements thereof without departing from the scope of the invention. In addition, may modifications may be made to adapt a particular situation or material to the teachings of the invention without departing from the essential scope thereof. Therefore, it is intended that the invention not be limited to the particular embodiment disclosed as the best mode contemplated for carrying out this invention.

What is claimed is:

1. A hydrogen gas generation system comprising:

an enclosure;

at least one hydrogen generator mounted in said enclosure, said at least one hydrogen generator having a plurality of electrochemical cells coupled in a serial electrical arrangement, said electrochemical cells each having an anode and a cathode;

at least one temperature sensor mounted within said enclosure;

a first heat generation device mounted in said enclosure and operably coupled to said at least one temperature sensor;

a ventilation duct coupled to said enclosure, said ventilation duct having an inlet and an outlet; and, a second heat generation device operably coupled to said ventilation duct to heat air in said ventilation duct prior to said air entering said enclosure;

a third heat generation device operably coupled to said ventilation duct to heat air in said ventilation duct and arranged to heat said air in series with said second heat generation device prior to said air entering said enclosure;

wherein said second heat generation device is configured to operate when an ambient temperature is below a first threshold and said at least one hydrogen generator is generating hydrogen gas;

wherein said third heat generation device is configured to operate when said ambient temperature is below said first threshold and an enclosure temperature is below a second threshold and said at least one hydrogen generator is generating hydrogen gas.

2. The hydrogen gas generation system of claim 1 further comprising an air outlet coupled to said enclosure.

3. The hydrogen gas generation system of claim 2 wherein said at least one temperature sensor is mounted adjacent to said at least one hydrogen generator.

4. The hydrogen gas generation system of claim 3 further comprising a water phase separation device mounted within said enclosure, said water phase separation device being operably coupled to said at least one hydrogen generator.

5. The hydrogen gas generation system of claim 4 wherein said at least one temperature sensor is at least two temperature sensors and at least one of said temperature sensors is mounted on said water phase separation device.

6. The hydrogen gas generation system of claim 3 further comprising a means for operating said first heat generator electrically coupled to said at least one temperature sensor and said first heat generator wherein said means for operating initiates operation of said first heat generator in response to a signal from said temperature sensor.

7. A hydrogen gas generation system comprising:

an enclosure;

an electrochemical cell stack mounted in said enclosure, said cell stack having means for generating hydrogen gas, an inlet for receiving water and an outlet for providing hydrogen gas;

a ventilation duct coupled to said enclosure, said ventilation duct having an inlet and an outlet exposed to the interior of said enclosure;

a first heat generation device mounted to said ventilation duct between said inlet and said outlet;

a temperature sensor mounted within said enclosure;

a second heat generation device mounted to said ventilation duct in series with said first heat generation device and operably coupled to said temperature sensor; and, a controller operably coupled to said temperature sensor and said second heat generation device, said controller having a processor responsive to executable computer instructions for operating said first heat generation device in response to an ambient temperature being below an ambient threshold and said electrochemical cell stack generating hydrogen gas;

wherein said processor is further responsive to executable computer instructions for operating said second heat generation device in response to ambient temperature being below an ambient threshold and a signal from said temperature sensor indicating an enclosure temperature less than a first predetermined threshold when said electrochemical cell stack is generating hydrogen gas.

8. The hydrogen gas generation system of claim 7 wherein said controller further includes a means for deactivating said second heat source in response to a signal from said temperature sensor indicating an enclosure temperature greater than a second predetermined threshold.

9. The hydrogen gas generation system of claim 8 further comprising a third heat generation device mounted within said enclosure and operably coupled to said controller, wherein said processor is further responsive to operating said third heat generation device during a standby mode and when a signal from said temperature sensor indicating an enclosure temperature less than a fourth predetermined threshold predetermined threshold.

10. The hydrogen gas generation system of claim 9 wherein said controller includes means for activating said third heat generation device in response to a signal from said temperature sensor indicating a temperature less than a third predetermined threshold.

11. The hydrogen gas generation system of claim 10 wherein said first predetermined threshold is 8C, said second predetermined threshold is 13C, and said third predetermined threshold is 3C.

12. The hydrogen gas generation system of claim 7 further comprising a plurality of temperature sensors mounted within said enclosure and operably coupled to said controller.

* * * * *